United States Patent [19]

Straiton

[11] Patent Number: 4,905,875

[45] Date of Patent: Mar. 6, 1990

[54] LIQUID DISPENSING ADAPTOR FOR DISPOSABLE SPIGOTS

[76] Inventor: Albert T. Straiton, #209 - 2678 McCallum Road, Abbotsford, British Columbia, Canada, V2S 3R3

[21] Appl. No.: 203,316

[22] Filed: Jun. 6, 1988

[30] Foreign Application Priority Data

Feb. 26, 1988 [CA] Canada ..... 559985

[51] Int. Cl.[4] ..... B67D 1/14

[52] U.S. Cl. ..... 222/505; 222/105; 222/556; 141/354; 141/360

[58] Field of Search ..... 222/96, 105, 212-213, 222/498, 501, 505, 508-509, 517, 545-546, 556; 141/354, 357, 360, 362; 137/320-323; 251/228-229, 231, 236, 243

[56] References Cited

U.S. PATENT DOCUMENTS

| | | | |
|---|---|---|---|
| 3,313,516 | 4/1967 | Peterson | 251/243 X |
| 3,376,582 | 4/1968 | Samuels | 222/509 X |
| 3,696,969 | 10/1972 | De Van et al. | 222/105 |
| 4,138,092 | 2/1979 | Apellaniz | 251/325 |
| 4,211,348 | 7/1980 | Scholle | 222/498 |
| 4,448,329 | 5/1984 | Vilaseca et al. | 222/96 |
| 4,784,301 | 11/1988 | Wells | 222/505 |

*Primary Examiner*—Michael S. Huppert

*Attorney, Agent, or Firm*—Merchant, Gould, Smith, Edell, Welter & Schmidt

[57] ABSTRACT

An adaptor for attachment to the spigot of a standard disposable "bag-in-box" container for liquids such as wine or milk is disclosed. The adaptor allows the user to conveniently dispense liquid from the spigot to a glass using only one hand. The adaptor incorporates a collar for attachment to the spigot, and a handle which is activated by pressure from the glass to open the spigot. The handle pivots on two horizontal arms extending from the collar. Connected to the handle are two downwardly extending arms which meet at a central horizontally projecting protuberance. By pressing the handle, the V-shaped arms are rotated upwardly and the horizontal protuberance is pressed upwardly against the toggle lever of the spigot.

13 Claims, 4 Drawing Sheets

LIQUID DISPENSING ADAPTOR FOR DISPOSABLE SPIGOTS

BACKGROUND OF THE INVENTION

The present invention relates to the dispensing of liquids from "bag-in-box" disposable containers, and more particularly to a device for facilitating the dispensing of liquids from such containers.

Disposable "bag-in-box" containers are in widespread commercial use for packaging various liquids such as milk, fruit juices, water and wine, in relatively large volumes such as 2 litres, 4 litres, or 16 litres. Such containers typically consist of a flexible plastic bag supported within a relatively rigid cardboard box. Such containers allow the consumer to purchase, store and dispense relatively large quantities of such liquids from a disposable container with relative convenience.

A particular spigot and spout assembly has been developed for such containers which facilitates the filling of and dispensing from the flexible bag. This type of spigot and spout assembly is shown in U.S. Pat. No. 4,211,348 issued July 8, 1980 to Scholle. Such spigot and spout assemblies are referred to hereinafter as "disposable spigots". A spout is provided in the plastic bag near the bottom of the bag. A spigot fits within the spout and has a flexible transverse wall with an integral toggle lever which the user can manipulate to flex the wall. When the lever is released, the transverse wall seals the path of egress from the spout. When the lever is raised, the wall is flexed and the path of egress is opened.

In order to prevent accidental opening of the spigot during storage and transportation, the spigot is formed so that the toggle lever is housed within the cylindrical recess defined by the walls of the spigot. This makes operation of the spigot cumbersome and uncomfortable for the user, as the user must insert a thumb or finger into the cylindrical recess and maintain pressure on the toggle lever at an awkward angle. The spigot is typically not rigidly secured in the box and it may be difficult for the user to get a solid grip on the lever in order to apply pressure. Furthermore, two hands will be required to fill a wine glass, for example, as one hand is required to hold the glass and the other to apply pressure to the toggle lever.

The present invention provides an adaptor which facilitates the dispensing of liquid from disposable spigots and allows the dispensing of liquids from the disposable spigot into the glass using one hand only.

SUMMARY OF THE INVENTION

The present invention provides an adaptor for disposable spigots having a projecting spout and a dispensing lever comprising a collar adapted for mounting on the neck of the spigot and a handle mounted for a pivotal rotation on such collar. A horizontal projection is attached to the handle so that when the handle is rotated, the projection is rotated upwardly against the dispensing lever, thereby dispensing the liquid. Preferably, the handle rotates on two projecting horizontal arms.

BRIEF DESCRIPTION OF THE DRAWINGS

In drawings which illustrate a preferred embodiment of the invention.

DETAILED DESCRIPTION OF A PREFERRED EMBODIMENT OF THE INVENTION

Figure 1:
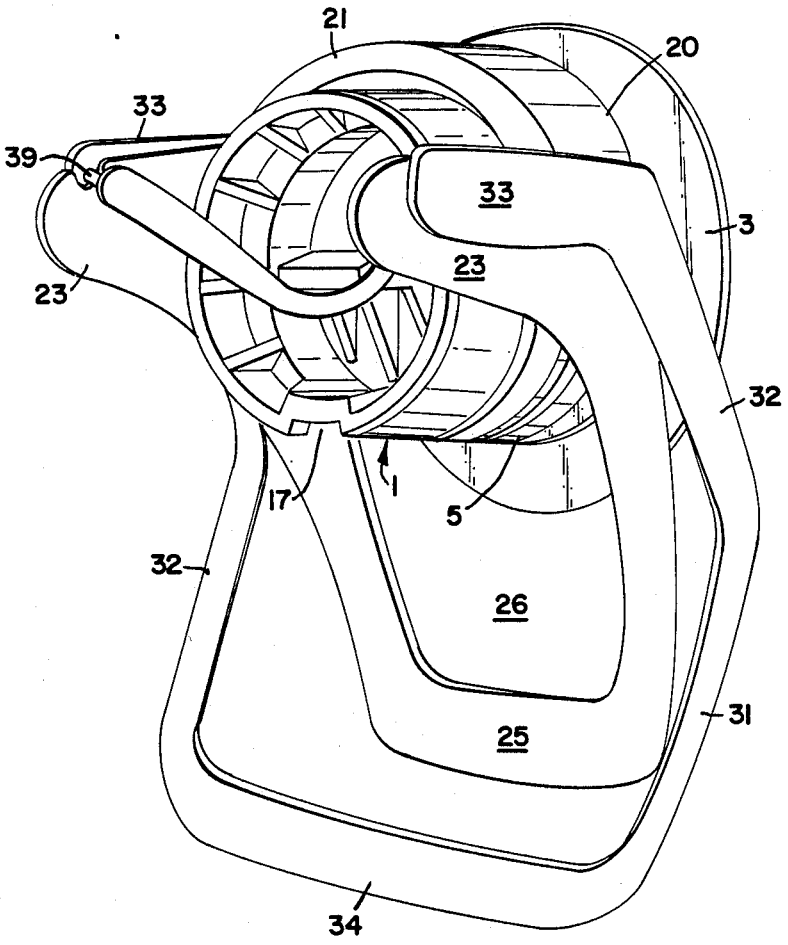
FIG. 1 is a perspective view of the adaptor of the invention installed on a disposable spigot.
Figure 2:
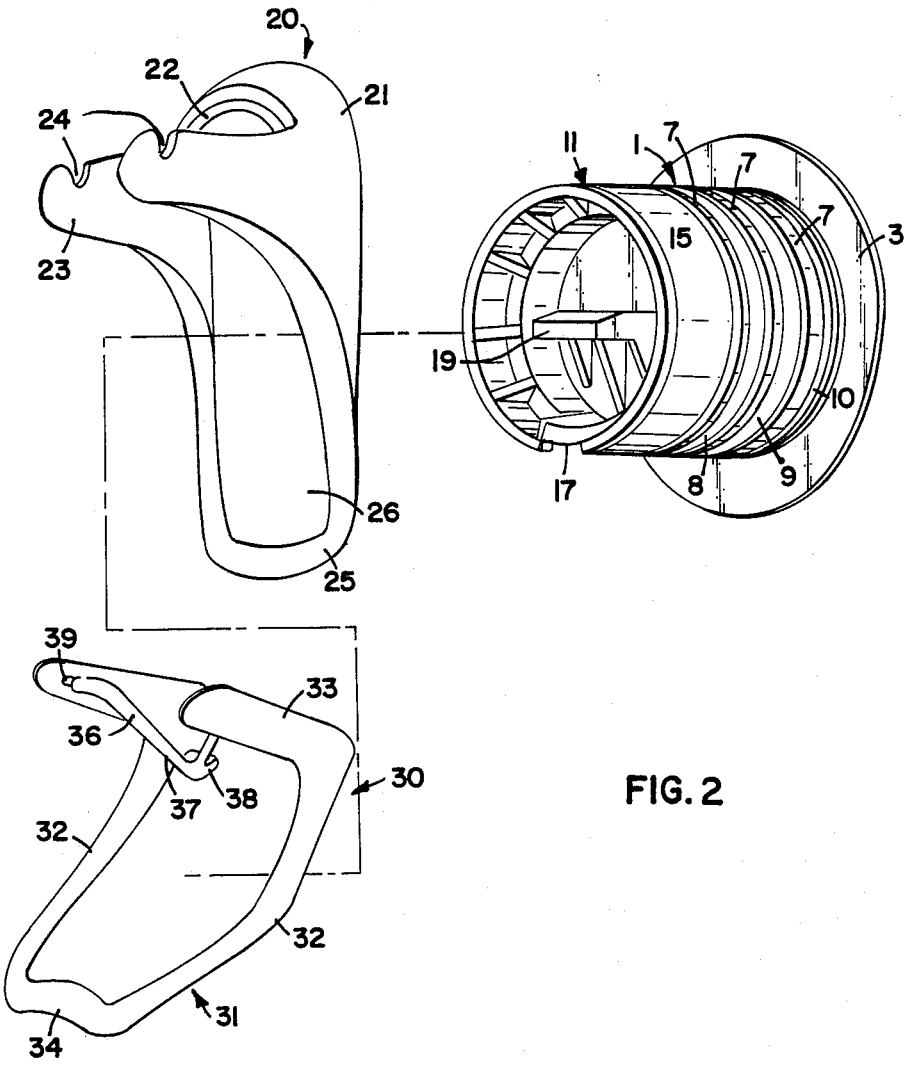
FIG. 2 is an exploded view of the adaptor of the invention and disposable spigot shown in FIG. 1.
Figure 3:
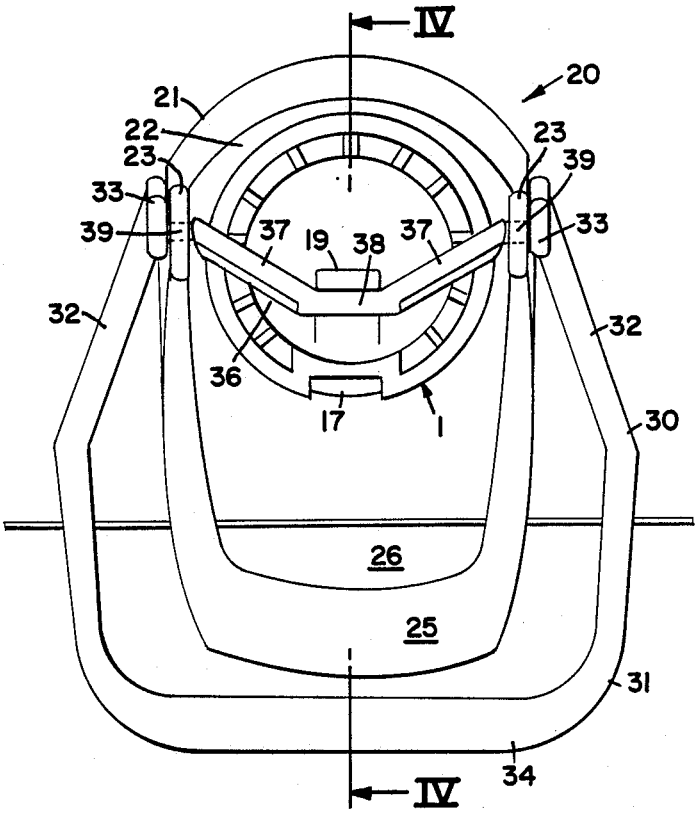
FIG. 3 is a front view of the adaptor and spigot shown in FIG. 1.
Figure 4:
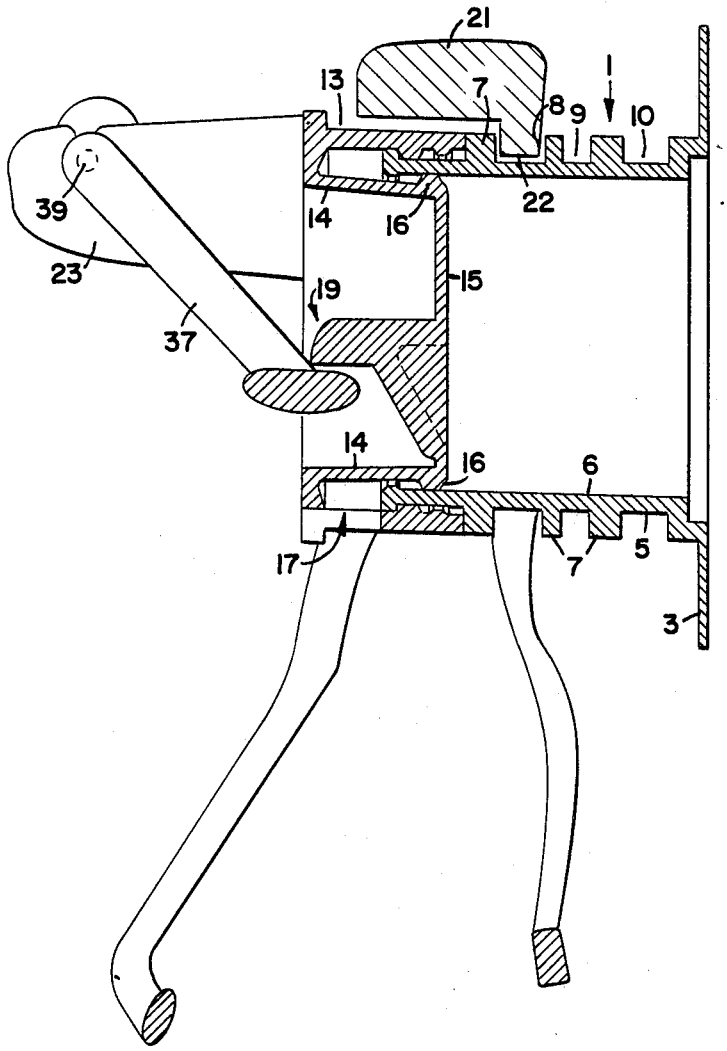
FIG. 4 is a cross-sectional view taken along lines IV—IV of FIG. 3.

Referring to FIGS. 1 through 4, a spigot and spout assembly for disposable "bag-in-box" containers, as disclosed in U.S. Pat. No. 4,211,348, is indicated as 1. It has an annular flange 3 at its inner end for sealed connection to the flexible plastic bag of the container. Extending from the flange 3 is a hollow cylindrical spout 5, having outwardly extending flanges 7, forming annular grooves 8, 9 and 10. These flanges are included to facilitate filling of the bag with liquid, and to lock the spout in an extended position in the box when the container is in position for dispensing.

The spigot is indicated as 11 and is formed of a cylindrical outer wall 13, a cylindrical inner wall 14, and a flexible, circular transverse wall 15 which seals off the spout. The outer edge of the inner portion of wall 14 has a sealing bead 16 which presses against the interior surface 6 of wall 5 of the spout to seal off the spout. An arcuate portion of the outer wall 13 is omitted to form opening 17 through which the liquid is dispensed.

Integral with transverse flexible wall 15 is a toggle-shaped lever 19 extending horizontally from the wall within the cylindrical opening formed by the spigot. By pressing upwardly on lever 19, flexible wall 15 is distorted inwardly and sealing bead 16 is drawn away from wall 6, allowing liquid to flow through opening 17. Upon release of lever 19, wall 15 returns to its normal position with sealing bead 16 sealing off further flow of liquid.

The adaptor of the invention comprises a collar portion 20 and a handle and lever portion 30. Collar portion 20 has a semi-circular collar 21 with a downwardly-extending flange 22 which fits snugly into the groove 8 of spigot 1. Two arms 23 extend horizontally from the collar, each having a groove or saddle 24 in which the lever portion sits. Downwardly-extending brace 25 is shaped to bear against the box of the container when the collar portion is installed on the spigot. Brace 25 forms an opening 26 wide enough to allow passage of the cylindrical portion of the spigot.

Lever portion 30 consists of handle 31 which in turn consists of two downwardly-extending arms 32 connected to horizontally extending arms 33, and a horizontal curved bar 34 against which the glass to be filled is pressed. Central V-shaped element 36 has two angled intermediate arms 37 which support a central horizontally projecting protuberance 38 which is sized and shaped to engage with the undersurface of toggle lever 19. The ends of intermediate arms 37 are connected to horizontal arms 33 by two cylindrical pins 39, shown in dotted outline in FIGS. 3 and 4, which fit snugly in grooves 24 and are able to pivot in grooves 24.

In operation, collar portion 20 is installed on spigot 1, resting in groove 8, and handle portion 30 is installed on collar portion 20 by seating pins 39 in grooves 24. In the rest position, gravity will cause projection 38 to come to rest near the underside of toggle lever 19. When the user presses a glass against horizontal bar 34, the handle portion rotates and projection 38 is forced upwardly against toggle lever 19. When pressure is released from the bar, the resiliency of wall 15 causes the toggle lever to return to its closed position.

As will be apparent to those skilled in the art, various modifications and adaptations of the above described structure may be made without departing from the spirit of the invention, the scope of which is defined in the appended claims.

The embodiments of the invention in which an exclusive property or privilege is claimed are defined as follows:

We claim:

1. An adaptor for dispensing liquid from a disposable spigot having a projecting spout and a dispensing lever pivotable about its inner end from a horizontally projecting closed position to an open position in which its outer projecting end is pivoted upwardly, and having a lower surface for engagement by a finger of a user for carrying out said upward pivotal movement and thereby placing said dispensing lever in said open position, comprising:

(a) a collar element adapted for mounting on said spout; and (b) a handle element pivotally mounted on said collar element and having a dispensing handle and a centrally located projection having an upper surface and being connected to said dispensing handle whereby movement of said dispensing handle causes said upper surface of said centrally-located projection to engage said lower surface of said dispensing lever and to pivot said dispensing lever to said open position, thereby dispensing said liquid.

2. The adaptor of claim 1 wherein said dispensing handle is downwardly extending.

3. The adaptor of claim 1 wherein said dispensing handle comprises two parallel arms.

4. The adaptor of claim 1 wherein said handle element further comprises a surface connected with said dispensing handle adapted for pressing a container thereagainst.

5. The adaptor of claim 1 wherein said projection comprises a protuberance having a horizontal surface for bearing against the underside of said lever.

6. The adaptor of claim 2 wherein said collar element comprises two horizontally extending arms

7. The adaptor of claim 6 wherein said handle is pivotally mounted on said horizontal arms.

8. The adaptor of claim 1 wherein said central projection is attached at one end thereof to said dispensing handle.

9. The adaptor of claim 1 wherein said central projection is attached at both ends thereof to said dispensing handle.

10. The adaptor of claim 8 wherein said projection is attached to said dispensing handle by an intermediate arm.

11. The adaptor of claim 6 wherein said projection is attached to said dispensing handle by intermediate arms extending outwardly from either end of said projection.

12. The adaptor of claim 11 wherein cylindrical pins are provided between the ends of said intermediate arms and said dispensing handle, said pins being adapted for rotation in said ends of said horizontal arms.

13. The adaptor of claim 9 wherein said projection is attached to said dispensing handle by an intermediate arm.

* * * * *